US005488942A

United States Patent [19]

Maughan

[11] Patent Number: 5,488,942

[45] Date of Patent: Feb. 6, 1996

[54] ATMOSPHERIC GAS BURNER HAVING EXTENDED TURNDOWN

[75] Inventor: James R. Maughan, Scotia, N.Y.

[73] Assignee: General Electric Company, Schenectady, N.Y.

[21] Appl. No.: 315,803

[22] Filed: Sep. 30, 1994

[51] Int. Cl.[6] ..... F24C 3/00

[52] U.S. Cl. ..... 126/39 E; 126/39 R; 126/39 K; 431/326

[58] Field of Search ..... 431/326; 126/39 E, 126/39 R, 39 K

[56] References Cited

U.S. PATENT DOCUMENTS

| | | | |
|---|---|---|---|
| 3,161,191 | 12/1964 | Stoligrosz et al. | 126/39 H |
| 3,592,180 | 7/1971 | Kweller | 126/39 H |
| 4,541,407 | 9/1985 | Sommers et al. | 126/39 E |
| 4,626,196 | 12/1986 | Stohrer, Jr. | 126/39 E X |
| 4,757,801 | 7/1988 | Le Monnier De Gouville et al. | 126/39 H |
| 5,024,209 | 6/1991 | Schaupert | 126/39 H |
| 5,133,657 | 7/1992 | Harris | 431/326 |
| 5,133,658 | 7/1992 | Le Monnier De Gouville et al. | 431/349 |
| 5,186,158 | 2/1993 | Ferlin | 126/39 R X |

FOREIGN PATENT DOCUMENTS

| | | | |
|---|---|---|---|
| 525299 | 2/1993 | European Pat. Off. | 126/39 E |

*Primary Examiner*—Larry Jones
*Attorney, Agent, or Firm*—Paul R. Webb, II

[57] ABSTRACT

An atmospheric gas burner produces improved turndown by separating a small number of the burner ports for simmer service. The burner has an internal baffle which includes a cup section having four outwardly-extending channels. Each one of the channels aligns with a separate one of the ports. The burner also includes a first fuel nozzle arranged to provide fuel to all of the ports in conventional fashion and a second fuel nozzle which provides fuel to the four simmer ports only. The second fuel nozzle has an injection orifice with a smaller cross-sectional area than the injection orifice of the first fuel nozzle. Preferably, the second orifice is sized to provide the same input rate at a maximum pressure that the first orifice does at a minimum pressure. By using a small number of ports for simmer service, the gas velocity through these ports is increased and improved turndown is achieved. In another embodiment, the baffle divides each port into upper lower sections, instead of separating some of the ports. The upper section of each port comprises approximately one-sixth to one-fourth of the total port area and is used for simmer service.

20 Claims, 2 Drawing Sheets

ATMOSPHERIC GAS BURNER HAVING EXTENDED TURNDOWN

BACKGROUND OF THE INVENTION

This invention relates generally to atmospheric gas burners, particularly to gas burners for domestic cooking appliances. The invention more specifically relates to improving the operating range of gas burners.

Atmospheric gas burners are commonly used as surface units in household gas cooking appliances. These gas burners typically comprise a burner head having a number of ports formed therein. A mixer tube introduces a mixture of fuel and air into the burner head. The fuel-air mixture passes through the ports and is ignited and burned. Achieving adequate operating range or turndown is a critical design parameter for atmospheric gas burners. Turndown is particularly important for gas burners used in gas cooking appliances because such burners are often required to operate over a wide range of inputs.

Many current gas burners are unable to provide an adequate simmer operation. This is because turndown is limited by the minimum gas velocity at the burner ports that will support a stable flame. When fuel input is reduced for simmer operation, the gas velocity through the ports becomes lower. Eventually, the gas velocity can become so low as to result in no flame at all or a marginal flame that is prone to being extinguished by disturbances in the surroundings, such as room drafts or oven door slams. The problem is particularly evident in the so-called sealed gas burner arrangements, i.e., burner arrangements lacking an opening in the cooktop surface around the base of the burner to prevent spills from entering the area beneath the cooktop, thereby facilitating cleaning of the appliance.

Accordingly, there is a need for an atmospheric gas burner capable of achieving extended turndown while maintaining the look, feel and cleanability of conventional cooktop burners.

SUMMARY OF THE INVENTION

The above-mentioned needs are met by the present invention which provides a gas burner comprising a burner body with a plurality of burner ports formed therein. A baffle located within the burner body divides the interior of the burner body into first and second chambers. The baffle comprises a cup section having an inlet tube extending axially therefrom and a plurality of channels extending radially therefrom. Each one of the channels aligns with a separate one of the ports. There are typically at least 24 ports and four channels. The burner also includes a first fuel nozzle aligned with an inlet conduit, such as a venturi tube, so as to provide fuel to the first chamber. A second fuel nozzle extends into the burner body and is aligned with the inlet tube of the baffle and thus provides fuel to the second chamber.

During normal operation, fuel from the first nozzle flows through all of the ports, but for simmer operation, fuel is injected via the second nozzle and flows through only the ports aligned with the channels. Since this is less than the total number of ports, the gas velocity through the ports is greater and increased turndown is possible. Moreover, the second fuel nozzle has an injection orifice with a smaller cross-sectional area than the injection orifice of the first fuel nozzle.

In another embodiment, the baffle located within the burner body comprises a cup section having an inlet tube extending therefrom. The outer rim of the cup section is aligned with the ports so as to divide each port into an upper section and a lower section. The lower section of each port faces a first chamber below the cup section, and the upper section of each port faces a second chamber above the cup section. Preferably, the upper section of each port comprises approximately one-sixth to one-fourth of the total port area. For normal operation, fuel from the first nozzle is discharged through both the lower and upper port sections. During simmer operation, fuel is injected into the second chamber via the second nozzle and is discharged through the upper port sections only.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
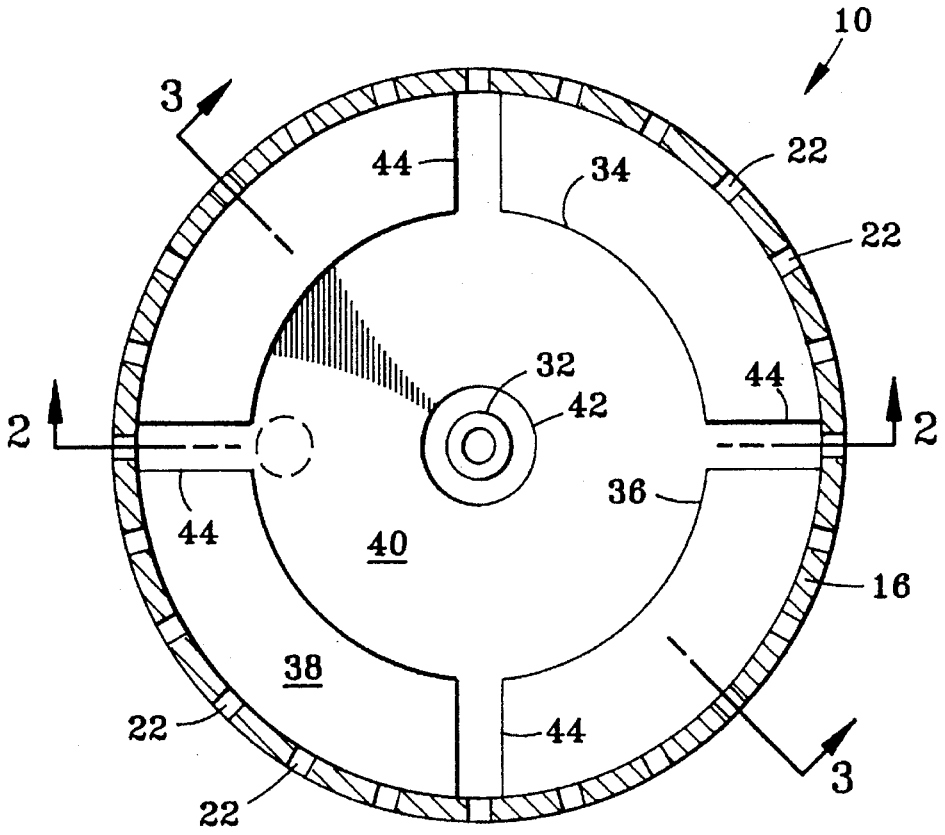
FIG. 1 is a cross-sectional top view of a first embodiment of a gas burner of the present invention.
Figure 2:
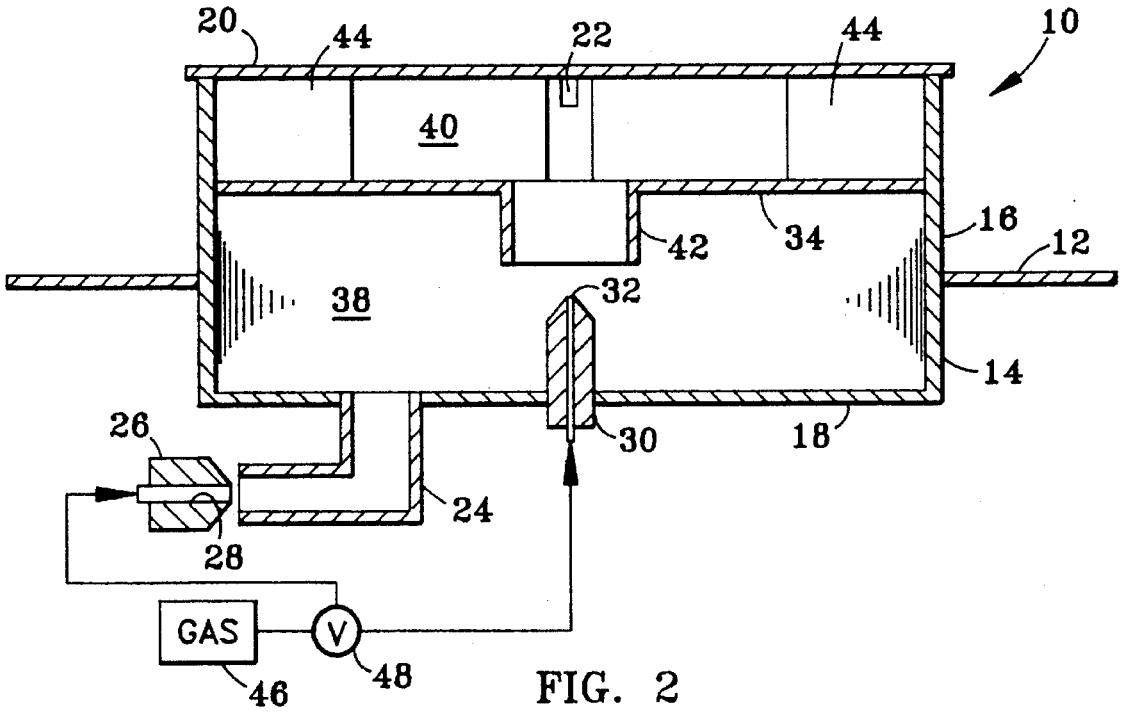
FIG. 2 is a cross-sectional plan view of the gas burner taken along line 2—2 of FIG. 1.
Figure 3:
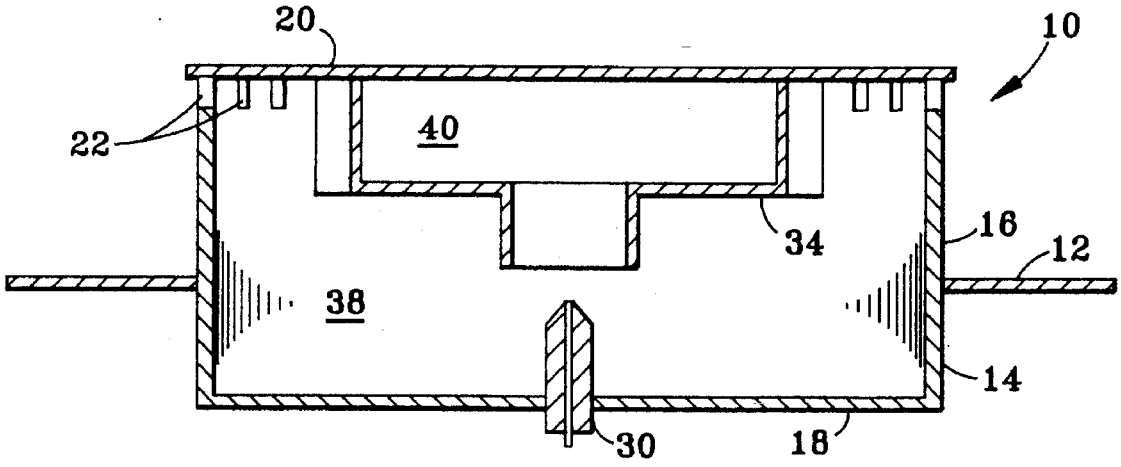
FIG. 3 is a cross-sectional plan view of the gas burner taken along line 3—3 of FIG. 1.

Referring to the drawings wherein identical reference numerals denote the same elements throughout the various views, FIGS. 1–3 show an atmospheric gas burner 10 of the present invention. The gas burner 10 is attached to a support surface 12 which forms a portion of the top side of a gas cooking appliance such as a range or cooktop. As best shown in FIGS. 2 and 3, the gas burner 10 is arranged as a so-called sealed burner. This refers to there being no opening between the support surface 12 and the base of the burner 10. The area beneath the support surface is thus sealed off to prevent spills from entering, thereby facilitating cleaning of the cooking surface. However, it should be understood that the present invention is not limited to use in sealed burner appliances, but is equally applicable to other types of gas cooking appliances.

The gas burner 10 comprises a burner body 14 which is preferably, although not necessarily, cylindrical. The burner body 14 has a substantially cylindrical sidewall 16, a bottom portion 18, and a top portion 20 which define a hollow interior. While one type of burner is described and illustrated, the present invention is applicable to other types of burners, such as stamped aluminum burners and separately mounted orifice burners, among others.

A plurality of burner ports 22 is formed in the sidewall 16. As used herein, the term "port" refers to an aperture of any shape from which a flame can be supported. The burner ports 22 are distributed around the circumference of the sidewall 18 at or near the top portion 20 and are typically, although not necessarily, evenly spaced. Generally, the total number of burner ports 22 will be in the range of about 24–30. Although all of these ports 22 are essentially identical in configuration, some differ in the manner with which they are supplied with fuel, as described below.

A mixing tube 24 (shown in FIG. 2), such as a venturi tube, has an inlet located externally of the burner body 14 and is connected to an opening in the bottom portion 18 so as to provide an inlet conduit to the interior of the burner body 14. A first or primary fuel nozzle 26 is located adjacent to the mixing tube 24 and has an injection orifice 28 aligned with the inlet of the mixing tube 24 so that fuel discharged from the injection orifice 28 flows into the mixing tube 24. Primary air to support combustion is obtained from the ambient space around the burner 10 and is entrained by the fuel jet in conventional fashion through the open area around the inlet of the mixing tube 24. Thus, the mixing tube 24 introduces a fuel-air mixture into the interior of the burner body 14. A second or simmer fuel nozzle 30 having an injection orifice 32 is arranged to extend axially through the bottom portion 18 of the burner body 14 so that the injection orifice 32 is located inside the burner body 14, pointing upward. The second fuel nozzle 30 is preferably located in the center of the bottom portion 18, while the first fuel nozzle 26 is located off center. The second injection orifice 32 has a cross-sectional area which is considerably smaller than that of the first orifice 28.

An internal baffle 34 is disposed inside the burner body 14. The baffle 34 includes a preferably cylindrical cup section 36 which is located in the upper portion of the burner body interior. The cup section 36 is positioned concentrically with respect to the burner body 14 so as to divide the interior of the burner body 14 into a first chamber 38 outside the cup section 36 and a second chamber 40 inside the cup section 36. An inlet tube 42 extends axially from the bottom of the cup section 36. The inlet tube 42 extends into proximity with the second fuel nozzle 30 so that the injection orifice 32 is aligned with the inlet tube 42. Fuel discharged from the second injection orifice 32 will thus flow into the inlet tube 42, entraining air from the first chamber 38 (air enters the first chamber 38 via the mixing tube 24). Thus, the inlet tube 24 introduces a fuel-air mixture into the second chamber 40.

The baffle 34 also includes four channels 44 which extend radially from the side of the cup section 36. The channels 44 are preferably spaced equally around the cup section 36. Each one of the channels 44 aligns with a corresponding one of the burner ports 22. The four ports aligned with the channels 44, referred to hereinafter as the simmer burner ports, are thus fluidly connected with the second chamber 40, while the remaining ports, referred to hereinafter as the primary burner ports, are in direct fluid communication with the first chamber 38.

Moreover, the simmer burner ports are in fluid communication with the first chamber 38 because some of the fuel-air mixture in the first chamber 38 will enter the second chamber 40 via the inlet tube 42. However, the fuel-air mixture injected into the second chamber 40 from the second orifice 32 will not flow back into the first chamber 38 during operation. Therefore, the primary ports are isolated from the second chamber 40. Thus, the primary ports are in fluid communication with the first chamber 38 but isolated from the second chamber 40, and the simmer ports are in fluid communication with both the first and second chambers 38,40.

While four channels 44 and thus four simmer ports are shown and described, the present invention is not necessarily limited to four of these elements. However, the number of simmer ports will be considerably less than the number of primary ports.

Both the first fuel nozzle 26 and the second fuel nozzle 30 are connected to a source of gas 46 via a two stage valve 48 (shown schematically). The valve 48 is controlled in a known manner by a corresponding control knob on the gas cooking appliance to regulate the flow of gas from the source 46 to the two fuel nozzles 26,30. The two stage valve 48 is of a type well known in the art and has a first stage in which a variable flow of fuel is provided to the first fuel nozzle 26 and a second stage in which a variable flow of fuel is provided to the second fuel nozzle 30.

The range of operation of the valve 48 is as follows. When wide open, the valve 48 is in the first stage and supplies fuel at maximum pressure to the first fuel nozzle 26. As the valve 48 is turned down, the fuel pressure is reduced until such point that a minimum first stage pressure is reached. Upon further turndown from this point, the valve 48 converts to the second stage wherein fuel is initially supplied to the second fuel nozzle 30 at the maximum pressure. Turndown of the valve 48 in the second stage reduces the fuel pressure until the burner 10 is turned off. The first orifice 28 is sized to produce the desired maximum burner input rate at the maximum pressure, and the second orifice 32 is preferably sized to provide the same input rate at the maximum pressure as the first orifice 28 does at the minimum first stage pressure. To achieve this, the ratio of the first orifice cross-sectional area to the second orifice cross-sectional area will be roughly equal to the turndown ratio for a single stage.

In operation, the control knob on the gas cooking appliance which corresponds to the desired gas burner 10 is manipulated, thereby causing the valve 48 to provide fuel to one of the two fuel nozzles 26,30. For regular operation, the valve 48 is adjusted to the first stage and fuel is directed to the first fuel nozzle 26. This fuel is discharged from the first orifice 28, entrains air for combustion, and enters the mixing tube 24. The fuel-air mixture flows into the first chamber 38 from the mixing tube 24 and most of the mixture is discharged through the primary burner ports for combustion. The rest of the fuel-air mixture in the first chamber 38 flows through the inlet tube 42 of the internal baffle 34 into the second chamber 40 for discharge through the simmer burner ports. Although there is a slight additional flow restriction to the mixture passing through the baffle 34, the regular operation of the burner 10 of the present invention is essentially indistinguishable from that of a conventional burner.

For simmer or extended turndown operation, the valve 48 is adjusted to the second stage, thereby directing fuel to the second fuel nozzle 30. Fuel is then discharged from the second orifice 32. This fuel jet entrains air from the second chamber 40, and the subsequent fuel-air mixture is directed into the inlet tube 42 for delivery to the first chamber 38. From here, the fuel-air mixture flows through the channels 44 and is discharged through the simmer burner ports for combustion. A higher port velocity is maintained for the same burner input rate because only the four simmer ports are open to flow instead of the entire 24–30 ports. A higher port velocity produces a more stable flame, thereby improving overall turndown.

The operation of the burner 10 is illustrated by way of an example in which the first orifice 28 is sized to provide a burner input rate of 9,600 BTU/hr at a maximum pressure of 4 inches of water column and an input rate of 1,200 BTU/hr at a minimum pressure of 0.0625 inches of water column. Then, if the second orifice 32 is sized to provide the same input rate at the maximum pressure that the first orifice 28 does at the minimum first stage pressure (i.e., has a cross-sectional area about one-eighth that of the first orifice 28), it will provide an input rate of 1,200 BTU/hr at the maximum pressure and an input rate of about 150 BTU/hr at a minimum pressure. Thus, the overall operating range of the burner 10 would be approximately 150–9,600 BTU/hr. These values are only given by way of example to demonstrate the improved turndown of the burner 10 and are not intended to limit the present invention.

Figure 4:
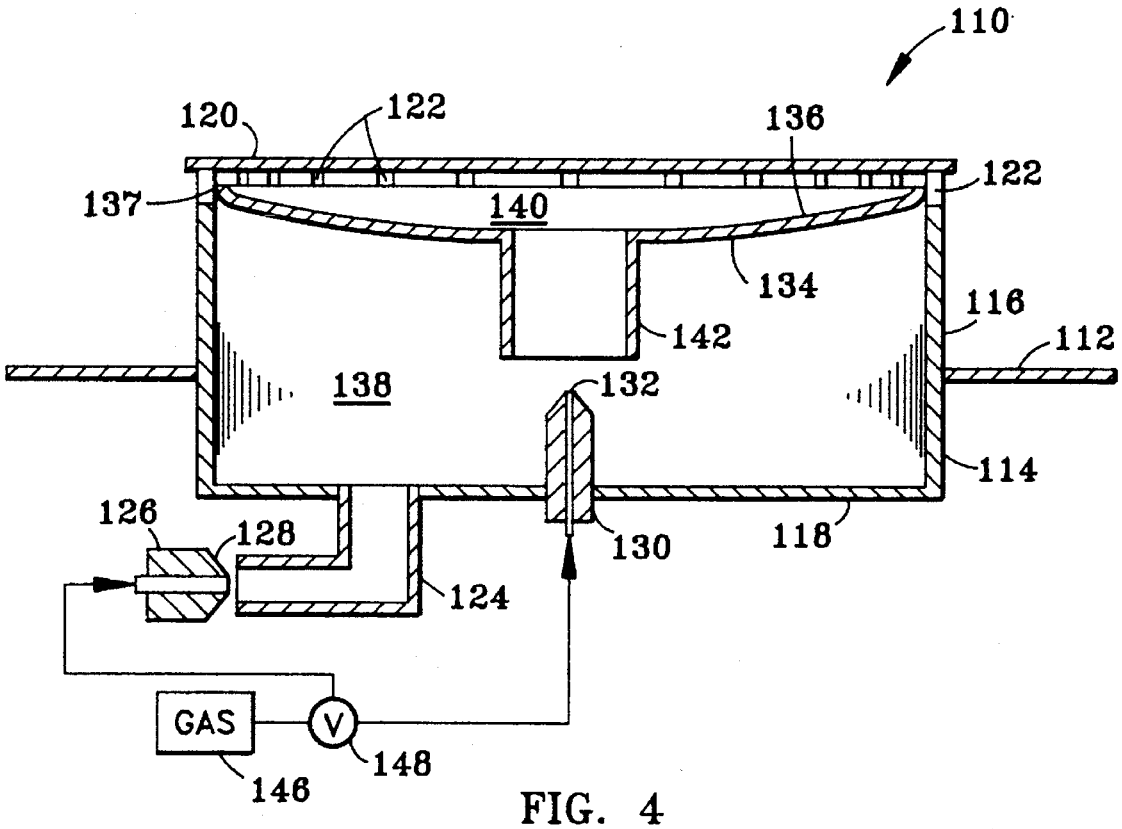
FIG. 4 is a cross-sectional plan view of a second embodiment of a gas burner of the present invention.

FIG. 4 shows an atmospheric gas burner 110 which is a second embodiment of the present invention. The gas burner 110 is attached to a support surface 112 which forms a portion of the top side of a gas cooking appliance such as a range or cooktop. The gas burner 110 comprises a preferably cylindrical burner body 114 having a substantially cylindrical sidewall 116, a bottom portion 118, and a top portion 120 which define a hollow interior. A plurality of burner ports 122 are formed in the sidewall 116 at or near the top portion 120 and are typically, although not necessarily, evenly spaced.

A mixing tube 124, such as a venturi tube, has an inlet located externally of the burner body 114 and is connected to an opening in the bottom portion 118 so as to provide an inlet conduit to the interior of the burner body 114. A first or primary fuel nozzle 126 is located adjacent to the mixing tube 124 and has an injection orifice 128 aligned with the inlet of the mixing tube 124 so that fuel discharged from the injection orifice 128 flows into the mixing tube 124. A second or simmer fuel nozzle 130 having an injection orifice 132 is arranged to extend axially through the bottom portion 118 of the burner body 114 so that the injection orifice 132 is located inside the burner body 114, pointing upward. As in the first embodiment, the second injection orifice 132 has a cross-sectional area which is considerably smaller than that of the first orifice 128.

An internal baffle 134 is disposed inside the burner body 114. The baffle 134 includes a preferably bowl-shaped cup section 136 which is located in the upper portion of the burner body interior. The cup section 136 is sized and positioned so that its outer rim 137 contacts the inner surface of the burner body 114. The cup section 136 thus divides the interior of the burner body 114 into a first chamber 138 below the cup section 136 and a second chamber 140 above the cup section 136. An inlet tube 142 extends axially from the bottom of the cup section 136. The inlet tube 142 extends into proximity with the second fuel nozzle 130 so that the injection orifice 132 is aligned with the inlet tube 142.

The baffle 134 is positioned so that the rim 137 of the cup section 136 aligns with the burner ports 122, thereby dividing each port 122 into upper and lower sections. The upper section of each port 122 comprises approximately one-sixth to one-fourth of the total port area. The lower sections of the ports 122 are in direct fluid communication with the first chamber 138, while the upper sections are in direct fluid communication with the second chamber 140. Moreover, the upper sections are in fluid communication with the first chamber 138 because some of the fuel-air mixture in the first chamber 138 will enter the second chamber 140 via the inlet tube 142. However, the fuel-air mixture injected into the second chamber 140 from the second orifice 132 will not flow back into the first chamber 138 during operation. Therefore, the lower sections are isolated from the second chamber 140. Thus, the lower sections are in fluid communication with the first chamber 138 but isolated from the second chamber 140, and the upper sections are in fluid communication with both the first and second chambers 138,140.

Both the first fuel nozzle 126 and the second fuel nozzle 130 are connected to a source of gas 146 via a two stage valve 148 which regulates the flow of gas from the source 146 to the two fuel nozzles 126,130. The valve 148 is the same as the valve described above in the first embodiment. Thus, for regular operation, the valve 148 is adjusted to its first stage and fuel is directed to the first fuel nozzle 126. This fuel is discharged from the first orifice 128, entrains air for combustion, and enters the mixing tube 124. The fuel-air mixture flows into the first chamber 138, and most of the mixture is discharged through the lower sections of the ports 122 for combustion. The remaining fuel-air mixture flows through the inlet tube 142 of the internal baffle 134 into the second chamber 140 for discharge through the upper sections. Although there is a slight additional flow restriction to the mixture passing through the baffle 134, the regular operation of the burner 110 of the present invention is essentially indistinguishable from that of a conventional burner.

For simmer or extended turndown operation, the valve 148 is adjusted to its second stage, thereby directing fuel to the second fuel nozzle 130. A fuel-air mixture is subsequently directed into the inlet tube 142 for delivery to the first chamber 138. From here, the fuel-air mixture is discharged through the upper sections for combustion. A higher port velocity is maintained for the same burner input rate because only the upper section of each port is open to flow instead of the entire port. A higher port velocity produces a more stable flame, thereby improving overall turndown.

The foregoing has described a gas burner with a dedicated simmer burner arrangement for improved turndown. While specific embodiments of the present invention have been described, it will be apparent to those skilled in the art that various modifications thereto can be made without departing from the spirit and scope of the invention as defined in the appended claims.

What is claimed is:

1. A gas burner comprising:

a burner body having an interior divided by a baffle into first and second chambers;

a first set of ports formed in said burner body, said first set of ports being in fluid communication with said first chamber;

a second set of ports formed in said burner body, said second set of ports being in fluid communication with said second chamber; and means for channeling a fuel and air mixture to both said first and second chambers for discharge from both said first and second sets of ports during a first mode of operation, and for channeling a fuel and air mixture to only said second chamber for discharge from only said second set of ports during a second mode of operation.

2. A gas burner according to claim 1 wherein said baffle adjoins said burner body to define said first and second sets of ports.

3. A gas burner according to claim 2 wherein said baffle includes a plurality of channels disposed in flow communication between said second chamber and respective ones of said second set of ports.

4. A gas burner according to claim 3 wherein said second set of ports is fewer in number than said first set of ports.

5. The gas burner of claim 4 wherein said first set of ports comprises at least 20 ports and said second set of ports comprises four ports.

6. A gas burner according to claim 2 wherein said burner body includes a plurality of circumferentially spaced apart apertures, and said baffle includes an outer rim aligned with said apertures to divide each of said apertures into upper and lower sections, with said lower sections defining said first set of ports, and said upper sections defining said second set of ports.

7. A gas burner according to claim 2 wherein said channeling means comprise an inlet tube extending from said baffle into said first chamber in flow communication with said second chamber.

8. The gas burner of claim 7 wherein said channeling means further comprise a first fuel nozzle having a first orifice arranged to inject fuel into said first chamber and a second fuel nozzle having a second orifice arranged to inject fuel into said second chamber through said inlet tube, said second orifice having a cross-sectional area which is smaller than that of said first orifice.

9. A gas burner comprising:

a burner body;

a plurality of ports formed in said burner body;

a baffle located within said burner body, said baffle comprising a cup section having an inlet tube extending axially therefrom and a plurality of channels extending radially therefrom, each one of said channels aligning with a separate one of said plurality of ports;

an inlet conduit formed in said burner body;

a first fuel injection orifice aligned with said inlet conduit; and a second fuel injection orifice aligned with said inlet tube.

10. The gas burner of claim 9 wherein said burner body is substantially cylindrical.

11. The gas burner of claim 10 wherein said cup section is substantially cylindrical.

12. The gas burner of claim 9 wherein said plurality of ports comprises at least 24 ports and said plurality of channels comprises four channels.

13. The gas burner of claim 9 wherein said inlet conduit comprises a venturi tube.

14. The gas burner of claim 9 wherein said second fuel injection orifice has a cross-sectional area which is smaller than that of first fuel injection orifice.

15. The gas burner of claim 14 wherein said second fuel injection orifice is sized to provide the same input rate at a maximum available pressure that said first fuel injection orifice does at a minimum available pressure.

16. A gas burner comprising:

a burner body;

a plurality of ports formed in said burner body;

a baffle located within said burner body, said baffle comprising a cup section having an outer rim and an inlet tube extending therefrom, said outer rim being aligned with said ports so as to divide each port into an upper section and a lower section;

an inlet conduit formed in said burner body;

a first fuel injection orifice aligned with said inlet conduit; and a second fuel injection orifice aligned with said inlet tube.

17. The gas burner of claim 16 wherein the upper section of each port comprises approximately one-sixth to one-fourth of the total port area.

18. The gas burner of claim 16 wherein said inlet conduit comprises a venturi tube.

19. The gas burner of claim 16 wherein said second fuel injection orifice has a cross-sectional area which is smaller than that of first fuel injection orifice.

20. The gas burner of claim 19 wherein said second fuel injection orifice is sized to provide the same input rate at a maximum available pressure that said first fuel injection orifice does at a minimum available pressure.

* * * * *